United States Patent [19]

Bifulco

[11] Patent Number: 4,699,385

[45] Date of Patent: Oct. 13, 1987

[54] CHESS PUZZLE BOARD AND PIECES

[76] Inventor: Eduardo Bifulco, 43-23 Ithaca St., Apt. 6-F, Elmhurst, N.Y. 11373

[21] Appl. No.: 852,766

[22] Filed: Apr. 16, 1986

[51] Int. Cl.[4] ..... A63F 3/02

[52] U.S. Cl. ..... 273/260; 273/157 R; 273/282; 273/DIG. 30; 446/901

[58] Field of Search ..... 273/157 R, 260, 282 A, 273/DIG. 30, 261, 288; 446/901

[56] References Cited

U.S. PATENT DOCUMENTS

| | | | |
|---|---|---|---|
| Re. 19,238 | 7/1934 | Burke | 273/157 R UX |
| 231,963 | 9/1880 | Luers | 273/157 R |
| 2,011,058 | 8/1935 | Krase | 273/157 R |
| 3,880,429 | 4/1975 | Blumenaus | 273/282 A |

FOREIGN PATENT DOCUMENTS

| | | | |
|---|---|---|---|
| 2082925 | 3/1982 | United Kingdom | 446/901 |

*Primary Examiner*—Anton O. Oechsle

*Attorney, Agent, or Firm*—Richard L. Miller

[57] ABSTRACT

A chess puzzle board is provided and consists of a plurality of differently formed sections each having a plurality of squares with alternating hook and loop pile fastener material to represent white and black designated squares. The sections can be combined when placed onto a loop pile fastener material area of a base member for forming a chess board pattern thereto. The chess playing pieces contain both hook and loop pile fastener material on the bottom so that they can be secured to any assigned square on the board during the play of the game.

2 Claims, 7 Drawing Figures

CHESS PUZZLE BOARD AND PIECES

BACKGROUND OF THE INVENTION

The instant invention relates generally to game boards and more specifically it relates to a chess puzzle board.

Numerous games boards have been provided in prior art on which games like checkers and chess may be played and which the games boards are sectional to be assembled together. For example, U.S. Pat. Nos. 231,963; 841,366 and 1,167,394 are all illustrative of such prior art. While these units may be suitable for the particular purpose to which they address, they would not be as suitable for the purposes of the present invention as heretofore described.

SUMMARY OF THE INVENTION

A primary object of the present invention is to provide a chess puzzle board that will overcome the shortcomings of the prior art devices.

Another object is to provide a chess puzzle board that is composed of a series of differently formed sections, each containing a plurality of squares which are assembled together by hook and loop pile fastener material.

An additional object is to provide chess puzzle board in which the chess pieces contain the hook and loop pile fastener material on the bottom so that they can be secured to any assigned square on the board during the play of the game.

A further object is to provide a chess puzzle board that is simple and easy to use.

A still more further object is to provide a chess puzzle board that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
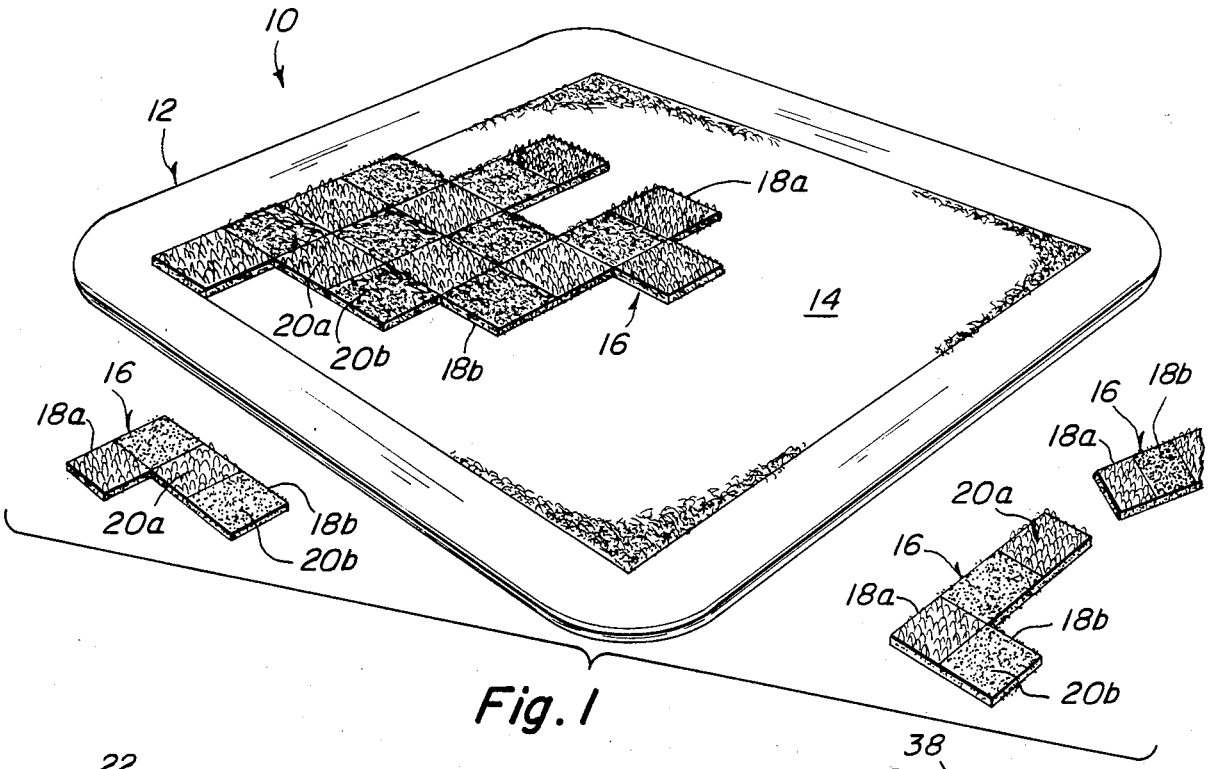
FIG. 1 is a perspective view of the chess puzzle board being assembled.

Turning now descriptively to the drawings, in which similar reference characters denote similar elements throughout the several views FIG. 1 illustrates a chess puzzle board 10 which contains a base member 12 that has a loop pile fastener material area 14 and a plurality of differently formed sections 16. Each of the sections 16 contain a plurality of squares with alternating hook and loop pile fastener material 20*a* and 20*b* to represent white and black designated squares 18*a* and 18*b*. The sections 16 can be combined when placed onto the loop pile fastener material area 14 of the base member 12 for forming a secured character board pattern thereto.

Figure 2:
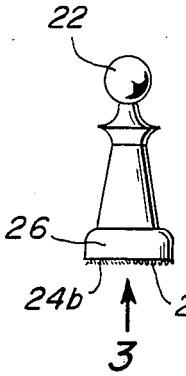
FIG. 2 is an elevational view of a typical pawn.
Figure 3:
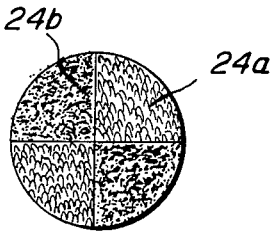
FIG. 3 is a bottom view taken in direction of arrow 3 in FIG. 2.

As typically shown in FIGS. 2 and 3 chess playing pieces 22 such as a pawn (as illustrated), a rook, a knight, a king and a queen playing pieces are also provided. Each of the chess playing pieces 22 have both hook and loop pile fastener material 24*a* and 24*b* on bottom 26. Each of the chess playing pieces 22 can be used on both the white and the black designated squares 18*a* and 18*b* during play of game.

Figure 4:
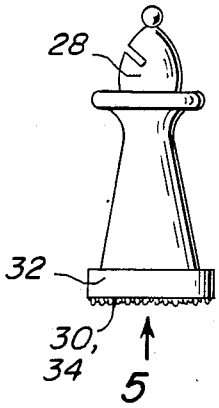
FIG. 4 is an elevational view of a typical bishop.
Figure 5:
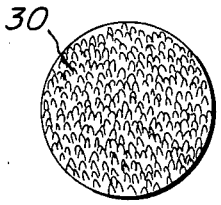
FIGS. 5 and 6 are bottom views of a black and a white bishop taken in direction of arrow 5 in FIG. 4.
Figure 6:
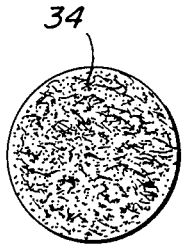

As typically shown in FIGS. 4, 5 and 6 a pair of bishop chess playing pieces 28 in which only one is illustrated are also provided. One of the bishop chess playing pieces 28 has hook fastener material 30 on bottom 32 while other of the bishop chess playing pieces 28 loop pile fastener material 34 on bottom 32. One of the bishop chess playing pieces 28 can be interlocked only on the white designation squares 18*a*. The other bishop chess playing piece 28 can be interlocked only on the black designation squares 18*b* during the play of the game.

This prevents bishops in play from being inadvertently placed on the wrong color.

Figure 7:
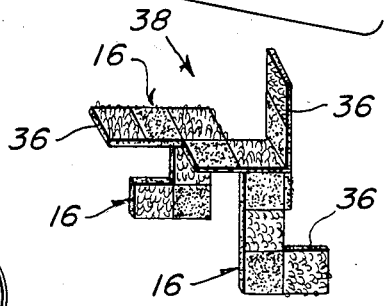
FIG. 7 is a perspective view of the puzzle pieces being assembled into a small structure.

Each of the sections 16 further has hook and loop pile fastener material along edges 36 so that the sections 16 can be combined together to form a small structure 38 independently from the base member 12 as shown in FIG. 7.

With this interlocking feature the instant invention to be used in a totally different manner to entertain small children.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A chess puzzle board which comprises:

(a) a base member having a loop pile fastener material area;

(b) a plurality of differently formed sections, each of said sections having a plurality of squares with visually distinct alternating hook and loop pile fastener material to represent white and black designated squares respectively so that the said sections can be combined when placed onto said loop pile fastener material area of said base member for forming a chess board pattern thereto;

(c) a plurality of chess playing devices, each of said chess playing pieces having both hook and loop pile fastener material on bottom so that each of said chess playing pieces can be interlocked on both said white and said black designated squares during play of game, wherein said chess playing pieces include a pawn, a rook, a knight, a king and a queen playing piece and;

(d) a pair of bishop chess playing pieces, one of said bishop chess playing pieces having only hook fastener material on bottom while other of said bishop chess playing pieces having only loop pile fastener material on bottom so that one of said bishop chess playing pieces can be interlocked only on said white designated squares and other of said bishop chess playing pieces can be interlocked only on said black designated squares during said play of said game.

2. A chess puzzle board as recited in claim 1 wherein each of said sections further having hook and loop pile fastener material along edges so that said sections can be combined together to form a small structure independently from said base member.

* * * * *